US005224839A

United States Patent [19]

Cardillo

[11] Patent Number: 5,224,839

[45] Date of Patent: Jul. 6, 1993

[54] VARIABLE DELIVERY PUMP

[75] Inventor: Joseph S. Cardillo, Palos Verdes, Calif.

[73] Assignee: Hydraulic Concepts, Redondo Beach, Calif.

[21] Appl. No.: 868,791

[22] Filed: Apr. 15, 1992

[51] Int. Cl.[5] ..... F04B 49/00; F04B 23/00; G05D 11/00; F16K 31/36

[52] U.S. Cl. ..... 417/282; 417/440; 137/115; 137/508

[58] Field of Search ..... 417/282, 440; 137/115, 137/503

[56] References Cited

U.S. PATENT DOCUMENTS

| | | | |
|---|---|---|---|
| 2,149,969 | 3/1939 | Lattner | 103/42 |
| 2,159,720 | 5/1939 | Wahlmark | 103/126 |
| 2,309,196 | 1/1943 | Jirsa | 103/42 |
| 2,333,885 | 11/1943 | Poulter | 103/126 |
| 3,476,055 | 11/1969 | Crowther | 417/440 X |
| 4,022,551 | 5/1977 | Hirosawa | 417/440 |
| 4,455,131 | 6/1984 | Werner-Larsen | 417/440 |
| 4,498,849 | 2/1985 | Schibbye et al. | 417/440 |
| 4,953,582 | 9/1990 | Kennedy | 137/115 |
| 5,074,760 | 12/1991 | Hirooka et al. | 417/440 |

FOREIGN PATENT DOCUMENTS

| | | | |
|---|---|---|---|
| 0588171 | 12/1959 | Canada | 137/508 |

*Primary Examiner*—Richard A. Bertsch
*Assistant Examiner*—Alfred Basichas
*Attorney, Agent, or Firm*—Fulwider Patton Lee & Utecht

[57] ABSTRACT

Variability of the output of a pump is achieved in a power efficient manner by forcing fluid through a check valve while intermittently shunting the pump's output side to is input side. A diverter valve is employed for this purpose wherein a perforated valve cylinder is rotated within a perforated sleeve. By controlling the axial position of the valve cylinder, the amount of overlap of the two component's perforations is variable and thereby serves to control the delivered output.

20 Claims, 3 Drawing Sheets

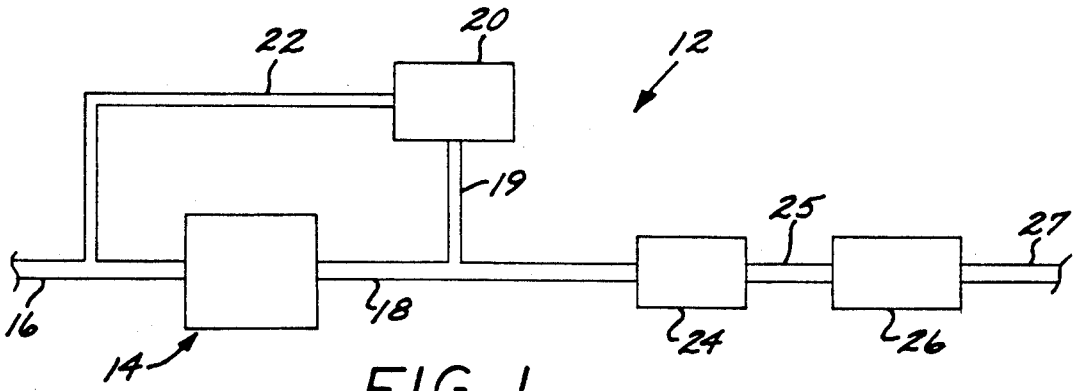
FIG. 1
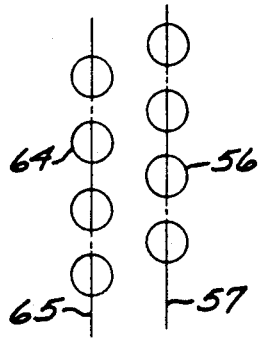
FIG. 8A
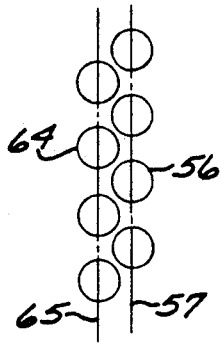
FIG. 8B
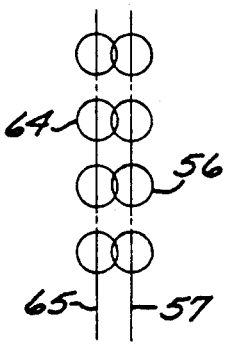
FIG. 8C
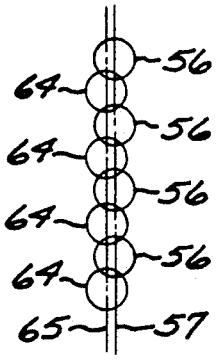
FIG. 8D
FIG. 11
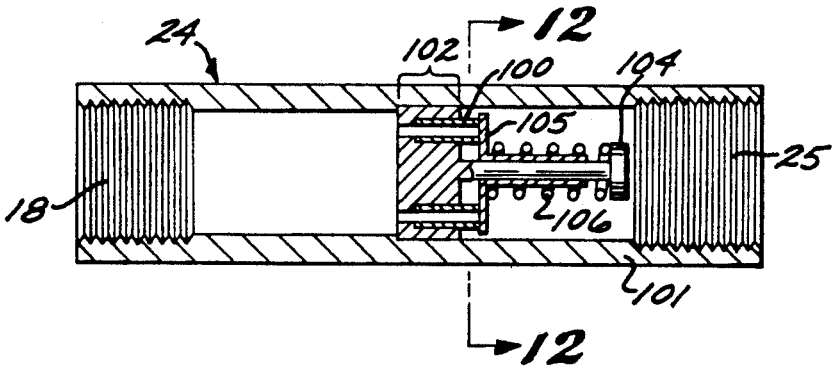
FIG. 12
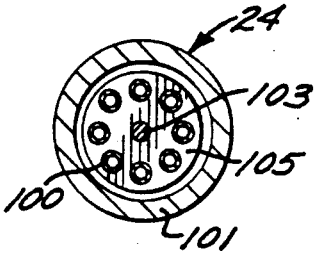

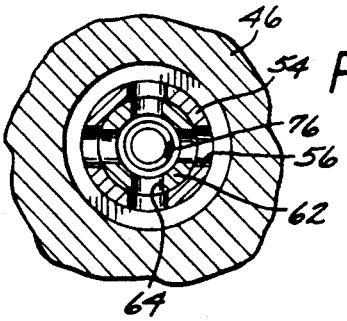
FIG. 7
FIG. 9
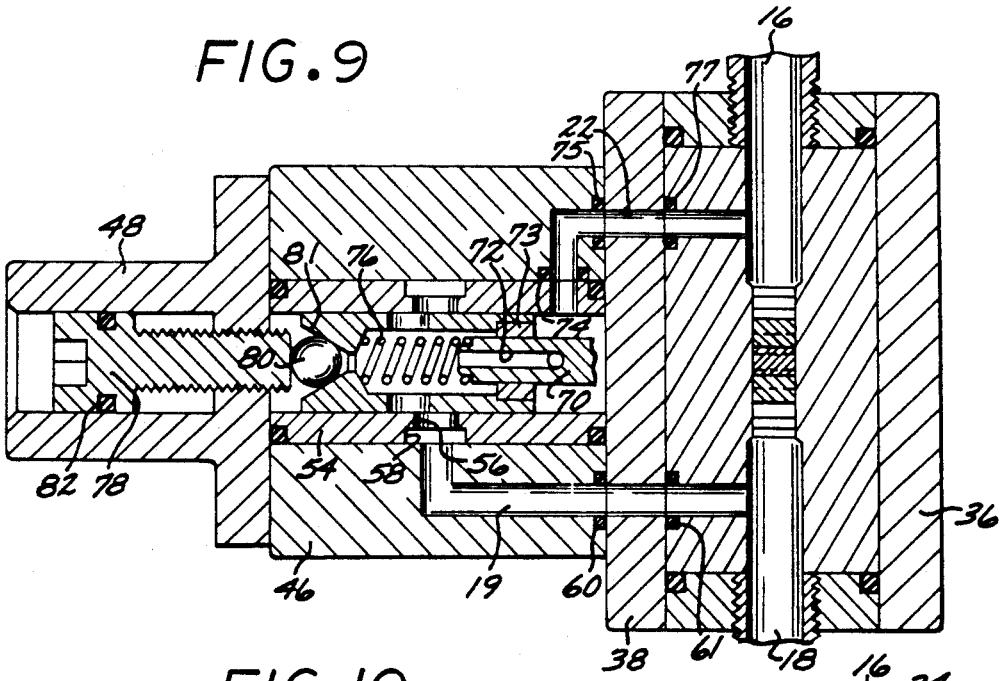
FIG. 10
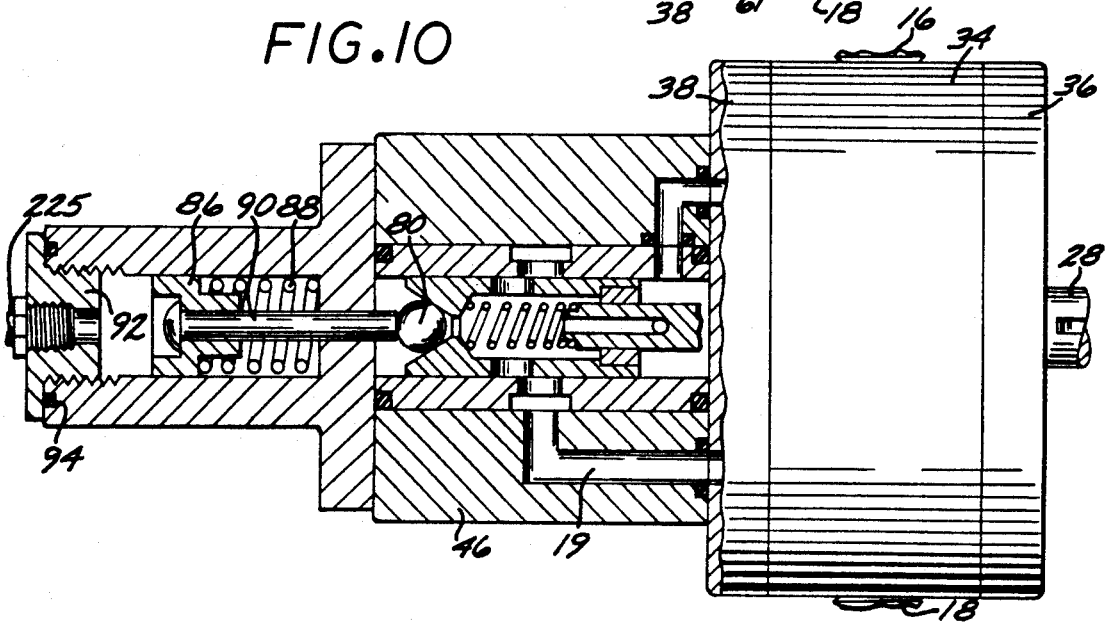

VARIABLE DELIVERY PUMP

BACKGROUND OF THE INVENTION

1. Field of the Invention

The present invention generally relates to variable delivery pumps and more specifically pertains to pump output control systems that provide for an infinitely variable volumetric output while minimizing the pump's power consumption.

2. Brief Description of the Prior Art

It is often desirable or even necessary to be able to reduce the volumetric output of a pump and while simply slowing down the pumping speed may be a viable alternative in some applications, such approach is not always an option. For example, the pump's speed may be dictated by an efficiency peak specific to the particular pump design or specific to the particular power system employed to drive the pump. Moreover, the pump is often driven as a peripheral function of a power system and the pump's volumetric output requirements may be completely independent of its driven speed. Consequently, it is most desirable to have the ability to vary a pump's volumetric output independent of its driven speed.

While simply bleeding off pressurized output for return to the low pressure side of a pump serves to reduce the net output of the pumping system, such approach results in gross inefficiencies as the pump's power consumption would remain substantially constant despite reductions in volumetric output. Continually returning pressurized fluid to pump input may additionally result in heating of the fluid being pumped which may in and of itself comprise an undesirable or unacceptable effect.

Gear pumps are often employed in various applications due to their relative affordability and reliability, however attempts to develop a variable delivery gear pump mechanism have met with limited success. In a typical approach, the length of engagement of the gears is varied by axial displacement of one gear so as to offset its position with respect to the other gear. Poor efficiency due to high internal leakage, limitations imposed by gear tooth strength problems at high offset/low partial displacements, and prohibitive manufacturing costs have prevented such designs from gaining success.

In the alternative, control systems have been developed that operate on the discharge fluid stream of pumps in an effort to provide for an adjustable volumetric output in a power efficient manner. Lipinski, U.S. Pat. No. 2,771,844 provides such a system in combination with a gear pump mechanism but the design nonetheless suffers from a number of inherent disadvantages. The Lipinski system relies on a rotating spool valve to alternately divert the pump's output between a discharge line and a return line in a cyclical fashion. The axial position of the spool valve determines the relative dwell times at either port and its axial position is infinitely adjustable. Since the pump encounters no significant resistance while its output is being returned to its low pressure side, power consumption is substantially a function of the volume actually delivered under pressure.

The spool valve configuration employed by Lipinski comprises an axially slidable cylinder rotationally driven by the pump's idler gear. An obliquely oriented groove formed on the cylinder's surface serves to alternately engage a discharge port and a return passage port that are disposed in the bore in which the cylinder rotates while the output side of the gear pump remains in constant communication with the groove. In order to prevent inefficiencies and other undesirable side effects associated with a momentary back flow, the width of the groove and the positions of the two ports are selected such that the discharge line is at no time set into communication with the return line. As a result, the output of the pump is necessarily momentarily completely blocked or trapped twice with every revolution of the spool valve just after the groove moves away from one port and just before it engages the other port. This causes a momentary, extreme build-up in pressure which results in destructive loads, noise, and some loss in efficiency. The fact that only a single pulse of output is delivered with every revolution of the spool valve results in further roughness, noise and vibration. Additional disadvantages associated with the Lipinski design are inherent in the fact that the spool valve simultaneously serves as the idler gear shaft. This subjects the spool valve to substantial side loads, friction and consequently wear which eventually results in an increasing amount of valve leakage. Further, if substantial pressures are involved, the side loads exerted on the valve can render its axial adjustment exceedingly difficult. While Lipinski does provide a variable delivery pumping system, its relatively slow cycling rate, the high internal loads and inefficiencies due to intermittent flow blockage, the resulting undesirable noise and vibration, and the side loads placed on the spool valve comprise substantial disadvantages.

SUMMARY OF THE INVENTION

The present invention provides an improved pump output control system that overcomes the disadvantages associated with a Lipinski-type design. The system is adaptable to a variety of pump designs and configurations, is especially power efficient, and provides for a relatively smooth output pressure profile.

Briefly, the output control system of the present invention employs a check valve in cooperation with a diverter valve. Fluid issuing from the pump flows through the check valve unless previously shunted back to the pump's input side through the diverter valve. The diverter valve is opened on an intermittent basis and the time period the valve is open relative the time period the valve is closed is continuously variable. Power consumption is minimized as no significant resistance is encountered by the pump while fluid is being returned to the pump's input side. Additionally, at no time during the diverter valve's operational cycle is fluid subjected to trapping, thus serving to avoid spurious internal loads and further enhancing power efficiency.

The diverter valve employs a perforated cylinder component that is continually rotated within a perforated sleeve component. The two components are axially shiftable relative one another and each component's perforations are arranged in an aligned linear pattern along the component's circumference. Consequently, the axial position of the cylinder relative the sleeve is determinative of whether any portions of each component's perforations will overlap one another during rotation of the cylinder. The exterior of the sleeve is in constant communication with the pump's output side while the interior of the cylinder is in communication with the pump's input side. When the cylinder is brought into a position such that portions of the cylinder's perforations overlap portions of the sleeve's perforations, the output of the pump is effectively shunted to its input side. Conversely, when the cylinder is positioned such that none of the perforations overlap one another, the pump's entire output is forced through the check valve.

The number and size of the perforations are selected such that upon axially positioning the cylinder so that its perforated circumference is in alignment with the perforated circumference of the sleeve, at least a portion of the perforations overlap one another at all angular orientations of the cylinder. A path through the diverter valve is thereby maintained during an entire rotation of the cylinder which in effect reduces the pump's output to zero. As the cylinder is axially displaced and the perforated circumferences become more and more offset form one another, the cylinder rotates through increasingly larger angles during which none of the perforations overlap one another. The pump's entire output is thereby forced through the check valve for proportionately longer periods during each rotation of the cylinder. As the cylinder is further displaced, the dwell angle or relative duration of an overlapping condition is gradually diminished until an axial position is reached where no overlap occurs during an entire rotation of the cylinder. At such point the output of the pump through the check valve is at its maximum. The shape of the perforations determines control linearity as well as the profile of the output flow pulses. It has been found that circular holes work well and are especially preferred in pressure controlled systems. The axial position of the cylinder is set manually via an adjustment screw, or is alternatively controlled by output fluid pressure such that volume or throughput is automatically controlled. Also, other control inputs can be applied in order to achieve various output characteristics.

The check valve employed in the present invention is selected so as to be able to open and close at rates commensurate with the number of perforations and the rotational speed of the cylinder. While the multiplicity of the perforations and hence the multiplicity of output pulses delivered with each rotation of the sleeve serves to significantly smooth out the overall output pressure profile, an accumulator may be additionally provided downline of the check valve to further smooth out pressure fluctuations in the pumping system's net outputs in cases where system compliance is unable to damp pulsations adequately.

The control system of the present invention adapted to a gear type pump is driven off the idler gear by a coupling that transfers rotational forces to the cylinder but decouples any radial loads the idler gear is subject to. This has the effect of minimizing friction encountered by the cylinder both during its rotation as well as upon axial repositioning.

Other features and advantages of present invention will become apparent form the following detailed description, taken in conjunction with the accompanying drawings, which illustrate by way of example, the principles of the invention.

BRIEF DESCRIPTION OF THE DRAWINGS

FIG. 1 is a schematic representation of the pump output control system of the present invention;

FIG. 7 is a cross-sectional view taken along line 7—7 of FIG. 4;

FIGS. 8*a–d* are two dimensional schematic representations of the perforated surfaces of sleeve 54 and valve cylinder 62 in various relative axial and rotational positions;

FIG. 9 is a cross-sectional view taken along line 9—9 of FIG. 4;

FIG. 10 is a cross-sectional view of an alternative embodiment of the present invention;

FIG. 11 is a greatly enlarged cross-sectional view of the check valve of the present invention; and FIG. 12 is a cross-sectional view taken along lines 12—12 of FIG. 11.

DETAILED DESCRIPTION OF THE PREFERRED EMBODIMENTS

Figure 2:
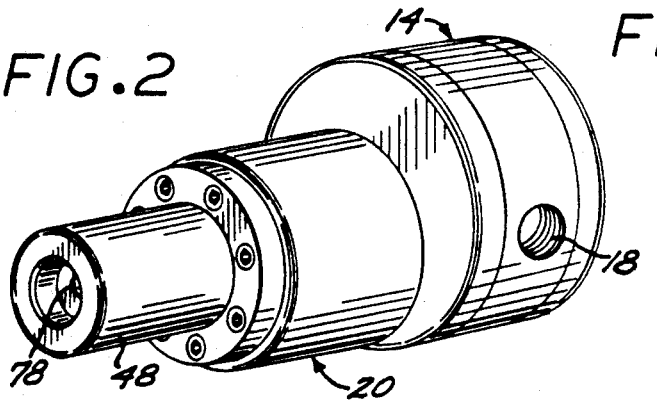
FIG. 2 is a perspective view of a pump and diverter valve assembly of the present invention.

FIG. 1 generally illustrates the pump output control system 12 of the present invention in schematic form. Fluid is supplied to the pump 14 via an input line 16 and is discharged from the pump into an output line 18. The discharged fluid is subsequently either forced through a check valve 24 into an accumulator 26 and out pressure line 27 or is shunted back to the pump's input line 16 via a shunt line 19, through a diverter valve 20 and via return line 22.

FIG. 2 illustrates a portion of the system schematically illustrated in FIG. 1 and more specifically depicts a mechanism combining the functions of the pump 14, the diverter valve 20 and associated plumbing, lines 16, 18, 19, and 22. The present invention is adaptable to any of a large variety of different pump configurations, including but not limited to vane pumps, piston pumps, and gear pumps. In the particular embodiment illustrated, the pump comprises a gear type mechanism wherein rotation of the input shaft 28, visible in FIG. 3, causes two internally disposed, intermeshing gears 30, 32 to rotate and thereby pump fluid therethrough.

Figure 3:
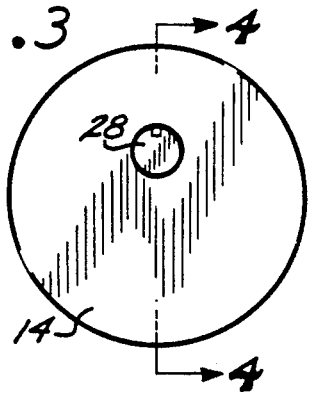
FIG. 3 is a plan view of the power input end of the pump portion shown in FIG. 2.
Figure 4:
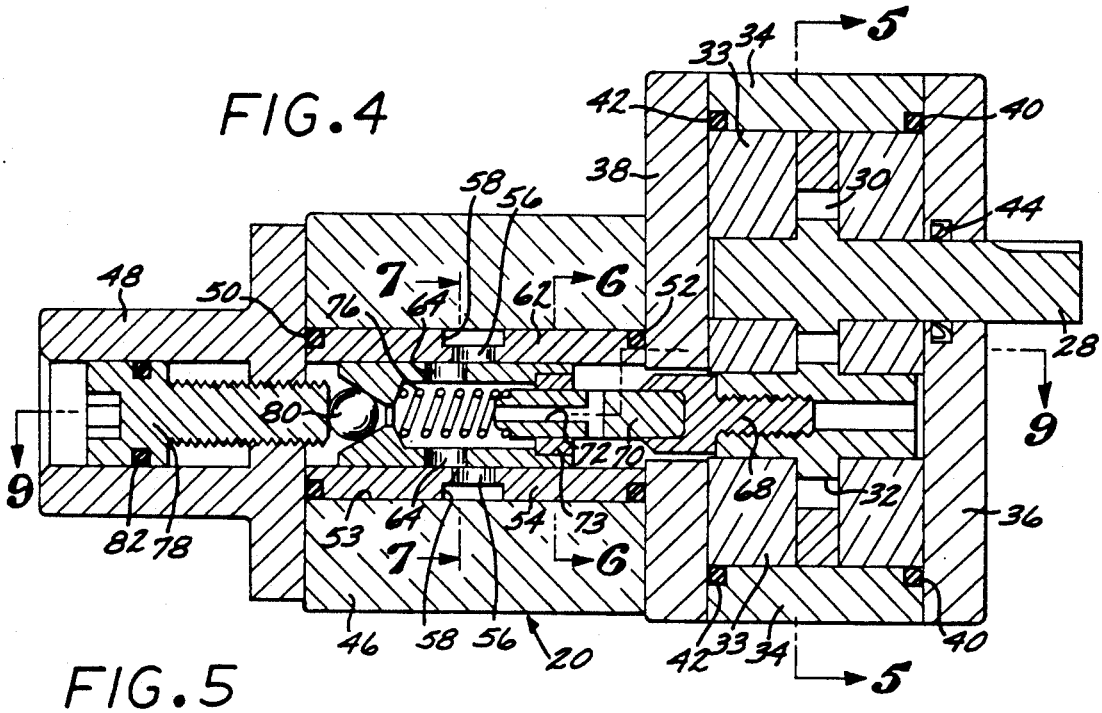
FIG. 4 is an enlarged cross-sectional view taken along lines 4—4 of FIG. 3.
Figure 5:
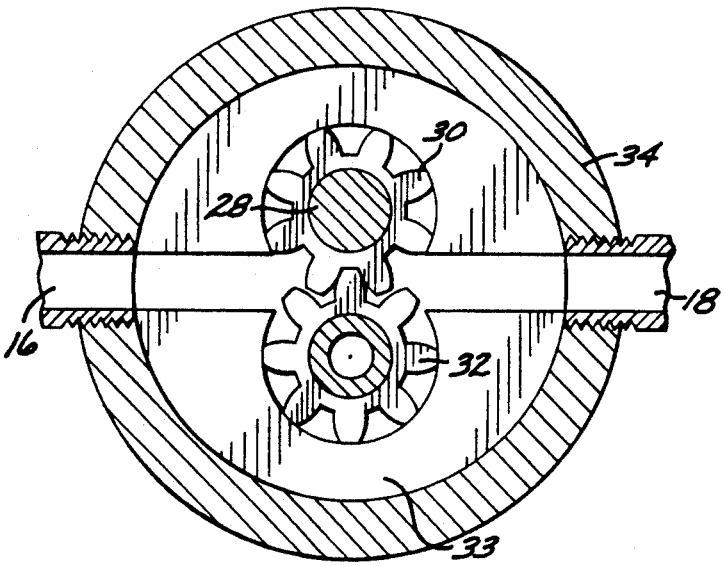
FIG. 5 is a cross-sectional view taken along line 5—5 of FIG. 4.

FIG. 4 is a cross-sectional view of the mechanism illustrated in FIGS. 2 and 3. The inner pump housing element 33 is encased within an outer casing 34 and face plates 36 and 38. O-rings 40 and 42 ensure a tight seal between the outer casing and the respective face plates. The housing element serves to rotatably position gears 30 and 32 in an intermeshing relationship. Drive gear 30 is rigidly affixed to input shaft 28 which extends through face plate 36 for attachment to a power source. Lip seal 44, held within a recess in face plate 36, provides a seal about the input shaft. As is more clearly visible in FIGS. 5 and 9, input line 16 supplies fluid to one side of the intermeshing gears 30 and 32 while output line 18 ducts fluid away from the opposite side of the gears.

Affixed to the exterior of face plate 38 is the diverter valve component 20 of the present invention. The diverter valve housing 46 is rigidly sandwiched between face plate 38 of pump 14 and endcap 48 while O-rings 50 and 52 seal the assembly. A central bore 53 is formed in diverter valve housing 46 that accommodates a sleeve 54 having a plurality of holes 56 therein that set its exterior surface into communication with its interior. In the embodiment illustrated, a total of four, equally spaced round holes 56 are distributed about the sleeve's circumference 57. Alternatively a different number of holes and other hole shapes can be employed. Of critical importance is the requirement that the dimension of each hole along the circumference of the sleeve exceeds the spacing between adjacent holes. The holes 56 are formed in the base of a groove 48 which is formed in the sleeve's exterior surface. As is visible in FIG. 9, shunt line 19 is integrally formed in and extends through pump housing 33, face plate 38 and diverter valve housing 46 to set output line 18 in communication with annular groove 58. O-rings 60, 61 seal the assembly.

Figure 6:
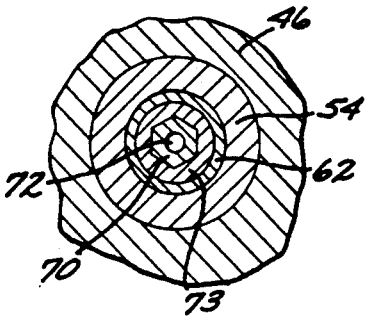
FIG. 6 is a cross-sectional view taken along line 6—6 of FIG. 4.

Valve cylinder 62 is sealingly disposed within sleeve 54 and is both rotatable as well as axially slidable relative thereto. The valve cylinder 62 has a number of holes 64 formed therein to set the exterior of the cylinder into communication with its interior. In the embodiment illustrated a total of four, equally spaced round holes are distributed about the cylinder's circumference 65. The holes are of similar size and spacing to the holes formed in the sleeve. The valve cylinder 62 is coupled to idler gear 32 such that only rotational forces are transmitted while the valve cylinder remains substantially isolated from any radial loads the idler gear may be subjected to. The coupling includes a connector fitting 68 rigidly secured to idler gear 32 and having a hexagonal opening 69 formed in its end, a hexagonal shaft 70 which is at one end received within the opening 69 formed in the fitting 68 and is at its other end slidingly received within a hexagonal bushing 73 secured to the valve cylinder. As is more clearly illustrated in FIG. 6 the hexagonal shape of the shaft 70 and the bushing 73 serves to transfer rotational forces from the hexagonal shaft 70 to valve cylinder 62, while freely allowing for the cylinder to be shifted axially relative thereto. Play between hexagonal shaft 70 and fitting 68 in conjunction with play between shaft 70 and bushing 73 serves to decouple radial loads. Splines or other drive means may alternatively be used in place of the described hexagonal configuration.

A bore 72 is formed in the interior of the hexagonal shaft 70 and sets the interior of valve cylinder 62 into communication with the interior of sleeve 54. As is seen in FIG. 9, return line 22, which is integrally formed in and extends through the sleeve 54, the diverter valve housing 46, face plate 38 and pump housing 33 sets the interior portion of sleeve 54 into communication with input line 16. O-rings 74, 75 and 77 serve to seal the assembly. Spring 76, extending from a seat formed on the end of shaft 70 and engaging the interior of valve cylinder 62, biases valve cylinder 62 towards end plate 48. Axial displacement of valve cylinder 62 towards the end plate is checked by adjustment screw 78 acting through ball 80 which is received in the conical seat 81 formed in the end cylinder 62. The adjustment screw is threadably received in the endcap 48 while O-ring 82 forms a seal thereabout.

FIG. 10 illustrates an alternative embodiment of the present invention wherein adjustment screw 78 is replaced by a piston mechanism. Piston 86 is sealingly and slideably received within a bore in endcap 48 and acts upon rod 90 against the bias of spring 88 to bear down upon ball 80. External line 95 sets the exterior surface of piston 86 into communication with pressure line 25 downstream of check valve 24 (not shown). The external line is received within the port fitting 92, which is threadably received within endcap 48, and sealed via O-ring 94.

The control system of the present invention requires a high response check valve to handle the potentially large number of power pulses per unit time. While many different check valve configurations are known in the art, the valve shown in FIGS. 11 and 12 have been found particularly capable of handling the response rate and flow requirements of the system of the present invention. FIG. 11 is a cross-sectional view of the preferred check valve configuration and shows a plurality of thin-walled tubes 100 held in position within cylindrical fitting 101 by core element 102. A shank 103 is attached to core element 102, extends downstream and is topped by a collar 104. A very thin, relatively flexible and light flange 105 having a sleeve 107 attached thereto is slidably disposed about shank 103 while spring 106 biases the flange 105 against tube ends to provide a seal. The length of sleeve 107 relative the length of shank 103 is selected to substantially limit lift. The sleeve length and number and diameter of tubes are selected to provide a low lift, high response check valve. In an alternative embodiment, the entire check valve 24 assembly can be fitted into output line 18 within pump housing 33. In such an alternative embodiment, line 95 can additionally be integrally formed within and extended through endcap 48, diverter valve housing 46, face plate 38, and pump housing 33 to set piston 86 into fluid communication with the pressure line downstream of check valve 24.

In operation, input line 16 supplies fluid to the pump 14. A power source is employed to rotate input shaft 28 which causes intermeshing gears 30 and 32 to counter-rotate relative one another and thereby force fluid from the input line 16 into the output line 18.

Rotation of idler gear 32 causes rotation of valve cylinder 62 via the coupling mechanism 68, 70 and 73. Spring 76 urges the valve cylinder against adjustment screw 78. When the axial and angular position of valve cylinder 62 relative sleeve 54 causes holes 56 and 64 to overlap one another a flowpath is provided to shunt pump output back to input line 16. Upon overlap, fluid from output line 18 flows via shunt line 19 through pump housing 33, face plate 38 and diverter valve body 46, into annular groove 58, through holes 56 and 64, through the interior of valve cylinder 62, through bore 72, into the interior space of sleeve 54 adjacent valve cylinder 62 and via return line 22 through sleeve 54, diverter valve housing 46, face plate 38 and pump housing 33 into input line 16.

FIGS. 8*a*–8*d* are schematic illustrations to assist in the understanding of the invention, simultaneously showing all of the holes 56 of sleeve 54 and all of the holes 64 of valve cylinder 62 as they would appear rolled out onto a two dimensional surface. The four Figures show the sleeve 54 and a valve cylinder 62 in various axial and rotational orientations relative one another. FIG. 8*a* shows the perforated circumference 65 of valve cylinder 62 sufficiently axially displaced relative the perforated circumference 57 of sleeve 54 such that no overlap of one set of holes with the other is possible during an entire rotation of the valve cylinder. This requires the adjustment screw 78 to be backed out to allow the spring 78 to sufficiently displace the valve cylinder 62 along its longitudinal axis. No fluid is thereby shunted to the input side of the pump and consequently volumetric output of the system is maximized.

FIGS. 8*b* and 8*c* show the sleeve 54 and valve cylinder 62 in an intermediate axially offset position. During rotation, relative angular orientations are encountered in which a flowpath is established (FIG. 8*c*) and interrupted (FIG. 8*b*). Slight displacements of the valve cylinder 62 and hence its perforated circumference 65 away from the sleeve's perforated circumference 57 results in shorter periods of overlap and longer interruptions while a slight clockwise adjustment of set screw 78 increases the dwell angle of overlap. The size and shape of the holes affects the linearity of the system's response to adjustments and additionally affects the shape of the pressure pulses. While circular holes provide good response, alternative perforation shapes and profiles may be preferred for other control versions, such as for example fuel metering control. The axial and rotational positions of the components as shown schematically in FIG. 8*c*, correspond to the views shown in FIGS. 4, 7, 9 and 10. This setting results in an intermediate volumetric output and, since the pump encounters no resistance while shunted, power is consumed at a reduced rate.

FIG. 8*d* depicts the perforated axes of sleeve 54 and valve cylinder 62 in alignment with one another. The size and spacing of the holes 56 and 64 ensure that some overlap occurs at all angular orientations of the valve cylinder. All of the pump's output is thereby shunted to the pump's input side to reduce net system output to zero and minimize power consumption.

It is to be appreciated that in the alternative embodiment illustrated in FIG. 10, the axial position of the valve cylinder 62 is automatically adjusted. More specifically, should the net output pressure of the system exceed a predetermined level, the valve cylinder is automatically shifted to increase overlap and thereby decrease net output. The predetermined level is a function of the spring's (76) spring rate and length. It has been found that the flow gain characteristic provided by round holes is ideally suited for this pressure regulated embodiment.

Each power pulse issuing from output line 18 passes through check valve 24. A valve cylinder and sleeve combination wherein each component has four holes therein causes the pump to issue four power pulses with each revolution during partially shunted operation. A power source delivering power at for example 1000 rpm consequently requires the check valve to open and reseal 4000 times per minute. The check valve configuration 24 illustrated in FIGS. 11 and 12 provides the necessary high response rate by virtue of its low mass and low lift design. The flexibility of flange 105 ensures a tight seal while reliance on only the thin-walled tube ends to form a seal against flange 105 maximizes specific sealing pressures. This has a self-cleaning effect as any debris caught between the flange and a tube end is subjected to the high pressure, tends to break up and is then swept from the sealing interface.

While a particular form of the invention has been illustrated and described, it will also be apparent to those skilled in the art that various modifications can be made without departing from the spirit and scope of the invention. Accordingly, it is not intended that the invention be limited except as by the appended claims.

What is claimed is:

1. A pump output control system for varying the volumetric delivery rate of fluid, comprising:

a pump, operative to drive fluid from its input side to its output side;

a check valve, operative to deliver therethrough fluid from the output side of said pump to system output while preventing the backflow of said delivered fluid; and a diverter valve, operative to intermittently open and thereby shunt substantially the entire amount of fluid delivered from the output side of said pump to its input side, wherein the time period in its open condition relative the time period in its closed condition is variable.

2. The control system of claim 1 wherein said diverter valve comprises:

a perforated valve cylinder member, having a longitudinal axis;

a perforated sleeve member fitted about said cylinder member's exterior so as to permit relative movement therewith;

means for controlling the axial position of one of said members relative the other; and means for rotating one of said members relative the other, whereby certain axial and rotational orientations of one member relative the other causes portions of said cylinder's perforations to overlap with portions of said sleeve's perforations and thereby set therethrough the pump's output side into fluid communication with its input side.

3. The control system of claim 2, wherein said sleeve member is held in a fixed position within a diverter valve body while said position controlling means is operative to control the axial position of the valve cylinder member relative thereto.

4. The control system of claim 2, wherein said sleeve member is held in a fixed position within a diverter valve body while said rotating means is operative to rotate the valve cylinder member relative thereto.

5. The control system of claim 4, wherein said position controlling means is operative to control the axial position of the valve cylinder member relative said sleeve member.

6. The control system of claim 5 wherein said axial position controlling means comprises:

means for biasing said valve cylinder member along said longitudinal axis; and a manually adjustable screw for limiting the axial displacement of said cylinder member by said biasing means.

7. The control system of claim 5 wherein said axial position controlling means comprises:

means for biasing said valve cylinder member along said longitudinal axis;

means for countering said biasing means by fluid pressure from system output.

8. The control system of claim 7 wherein said countering means comprises:

a piston in fluid communication with said system output and operative to urge said valve cylinder along said longitudinal axis opposite said biasing means' bias in response to pressurization of said system output.

9. The control system of claim 2 wherein said sleeve member's exterior surface is in constant fluid communication with said pump's output side while said valve cylinder member's interior is in constant fluid communication with said pump's input side.

10. The control system of claim 9 wherein said sleeve member is held in a fixed position within a diverter valve body and said axial position controlling means comprises:

means for biasing said valve cylinder member along said longitudinal axis; and a manually adjustable screw for limiting the axial displacement of said cylinder member by said biasing means.

11. The control system of claim 9 wherein said sleeve member is held in a fixed position within a diverter valve body and said axial position controlling means comprises:

means for biasing said valve cylinder member along said longitudinal axis;

means for countering said biasing means by fluid pressure from said system output.

12. The control system of claim 2 wherein said perforations in said sleeve member are arranged in an aligned pattern about its circumference.

13. The control system of claim 2 wherein said perforations in said valve cylinder member are arranged in an aligned pattern about its circumference.

14. The control system of claim 13 wherein said perforations in said sleeve member are arranged in an aligned pattern about its circumference.

15. The control system of claim 14 wherein said sleeve member's exterior surface is in constant fluid communication with said pump's output side while said valve cylinder member's interior is in constant fluid communication with said pump's input side.

16. The control system of claim 15 wherein said perforations are circular holes.

17. The control system of claim 16 wherein the diameters of said holes are greater than the spacing between adjacent holes.

18. The control system of claim 5 wherein said pump comprises a gear pump and wherein said valve cylinder is rotatably coupled to said pump.

19. The control system of claim 18 wherein said gear pump includes an idler gear and said valve cylinder is rotatably coupled thereto.

20. The control system of claim 19 wherein said valve cylinder is decoupled from any side loads said idler gear is subject to.

* * * * *